US007661972B2

(12) United States Patent
Okamura et al.

(10) Patent No.: US 7,661,972 B2
(45) Date of Patent: Feb. 16, 2010

(54) ELECTRICAL CONNECTOR

(75) Inventors: Seiji Okamura, Tokyo (JP); Haruhiko Murakami, Tokyo (JP)

(73) Assignee: Hirose Electric Co., Ltd., Tokyo (JP)

( * ) Notice: Subject to any disclaimer, the term of this patent is extended or adjusted under 35 U.S.C. 154(b) by 0 days.

(21) Appl. No.: 11/783,812

(22) Filed: Apr. 12, 2007

(65) Prior Publication Data

US 2007/0254534 A1 Nov. 1, 2007

(30) Foreign Application Priority Data

Apr. 28, 2006 (JP) ..... 2006-124613

(51) Int. Cl.
*H01R 13/15* (2006.01)

(52) U.S. Cl. ..... 439/260

(58) Field of Classification Search ..... 439/783, 439/495, 260

See application file for complete search history.

(56) References Cited

U.S. PATENT DOCUMENTS 6,773,287 B2 * 8/2004 Takashita ..... 439/260
7,083,455 B1 * 8/2006 Miura et al. ..... 439/260
7,112,079 B2 * 9/2006 Miura et al. ..... 439/260
2003/0220013 A1 * 11/2003 Lee ..... 439/495

FOREIGN PATENT DOCUMENTS

| | | |
|---|---|---|
| JP | 63-165787 U | 10/1988 |
| JP | 7-16384 | 3/1995 |
| JP | 2000-30784 | 1/2000 |
| JP | 2007-179760 | 7/2007 |

* cited by examiner

*Primary Examiner*—Tho D Ta
*Assistant Examiner*—Travis Chambers
(74) *Attorney, Agent, or Firm*—Kubotera & Associates, LLC

(57) ABSTRACT

An electrical connector for connecting a flat conductive member includes a plurality of terminals formed of a flat metal plate arranged on a housing in a direction perpendicular to a plate direction. Each of the terminals has a contact portion disposed at a position for receiving the flat conductive member to be inserted into a receptacle portion of the housing. A metal member having an engaging portion is attached to the housing for engaging an engagement portion of the flat conductive member, so that the flat conductive member does not come off backward. A pressing member is supported on at least one of the housing and the terminals to be rotatable. The metal member further includes an attaching portion attached to the housing. The metal member is attached to the housing such that the attaching portion is situated in parallel to a plate surface of the terminals.

18 Claims, 8 Drawing Sheets

ELECTRICAL CONNECTOR

BACKGROUND OF THE INVENTION

The present invention relates to an electrical connector. More specifically, the present invention relates to an electrical for connecting a flat conductive member and an electrical connector with a flat conductive member.

Conventionally, many types of flat conductive members are used, and include a flexible print circuit board (FPC), a flat cable, and the likes. In many cases, such a flat conductive member is connected to an electrical connector attached to a circuit board.

In general, the flat conductive member is integrated with fine cables or conductive members arranged in a row with a very small pitch. Accordingly, it is difficult to connect the flat conductive member to an electrical connector. Accordingly, an electrical connector may be provided with a pressing member to be rotatable. In this case, the flat conductive member is arranged above a contact portion of a terminal of the electrical connector. Then, the pressing member is rotated to press each of the fine cables of the flat conductive member against the corresponding contact portion, thereby connecting to the terminal.

In the flat conductive member, a reinforcement sheet is attached to a distal end portion thereof to be connected to the electrical connector. The flat conductive member is also provided with engaging portions such as cut portions at both side edges of the reinforcement sheet for engaging corresponding engaging portions of the electrical connector.

For example, as disclosed in Patent Reference 1, an electrical connector includes a housing. In the electrical connector, a lock arm is integrated with the housing on an inner surface thereof for receiving a flat conductive member (connecting member). The lock arm is provided with an arm protruding portion at a distal end of an arm spring portion of the lock arm, so that the arm protruding portion engages cut portions disposed at both side edges of the flat conductive member.

In Patent Reference 1, when the electrical connector is used, the flat conductive member is inserted into the housing in a longitudinal direction. At this moment, a side edge of the flat conductive member abuts against the arm protruding portion, and pushes the arm protruding portion outward, so that the flat conductive member proceeds inside the housing further.

When the cut portions of the flat conductive member reach the arm protruding portion, the arm spring portion snaps back to an original posture with elastic restoration force thereof. As a result, the cut portions engage the arm protruding portion, so that the flat conductive member no longer comes off the connector. Afterward, a pressing member is rotates to a close position, so that the flat conductive member firmly contacts with a contact portion of the electrical terminal, thereby securing electrical connection therebetween.

Patent Reference 2 has disclosed an electrical connector for connecting a flat conductive member (cable), and the electrical connector does not have the pressing member. The electrical connector in Patent Reference 2 is provided with a hook member formed of a metal plate in a curved shape instead of the lock arm in the electrical connector disclosed in Patent Reference 1.

The hook member is provided with an engaging portion formed of a metal plate bent in a thickness direction and a protruding portion having a U character shape. After the flat conductive member is inserted into the electrical connector from a distal end thereof in an oblique state, the electrical connector is pushed down to a horizontal state, so that the flat conductive member engages the engaging portion and the protruding portion. The protruding portion prevents the flat conductive member from retuning to the oblique state. The engaging portion engages cut portions of the flat conductive member, so that the flat conductive member does not come off.

Patent Reference 1: Japanese Patent Publication No. 2000-30784

Patent Reference 2: Japanese Utility Model Publication No. 07-16384

In the electrical connectors disclosed in Patent Reference 1 and Patent Reference 2, it is difficult to produce the lock arm or the hook member. Further, it is difficult to reduce a size of the electrical connector in a width direction thereof.

In particular, in the electrical connector in Patent Reference 1, the arm protruding portion has a complex shape and is integrated with the housing. Accordingly, a shape of a mold and a manufacturing process tend to be complicated. Further, the lock arm is formed of a resin same as that of the housing, thereby reducing strength thereof.

In the electrical connector in Patent Reference 2, after a metal plate is formed in a specific shape, and then the metal plate is bent in a complex shape to form the hook member. Accordingly, it is difficult to produce the hook member.

Further, the arm protruding portion of the electrical connector in Patent Reference 1, or the engaging portion and the protruding portion of the electrical connector in Patent Reference 2 protrude in the width direction of the electrical connector, i.e., an arrangement direction of the terminal, thereby increasing the size of the electrical connector in the width direction.

Further, the arm protruding portion or the engaging portion and the protruding portion deform elastically in the width direction. Accordingly, it is necessary to provide a space for the elastic deformation.

In this type of connector, a large number of terminals are arranged with an extremely fine pitch corresponding to the flat conductive member. Accordingly, it is desired to reduce the size of the electrical connector in the width direction, or dispose terminals in a limited width as many as possible. Therefore, it is critical to reduce the size of the electrical connector in the width direction.

Still further, in the electrical connector in Patent Reference 2, the protruding portion has the U character shape. Accordingly, in addition to the width direction, the size of the electrical connector is enlarged in a longitudinal direction of the cable as well.

In view of the problems described above, an object of the invention is to provide an electrical for connecting a flat conductive member and an electrical connector having a conductive member. In the present invention, the electrical connector has a small size and easy to produce.

Further objects of the invention will be apparent from the following description of the invention.

SUMMARY OF THE INVENTION

In order to attain the objects described above, according to an embodiment of the present invention, an electrical connector is provided for connecting a flat conductive member. In the electrical connector, a plurality of terminals formed of a flat metal plate is arranged on a housing in a direction perpendicular to a plate direction. Each of the terminals has a contact portion disposed at a position for contacting with the flat conductive member to be inserted into a receptacle portion of the housing.

Further, a metal member having an engaging portion is attached to the housing for engaging an engagement portion of the flat conductive member, so that the flat conductive member does not come off backward. A pressing member is supported on at least one of the housing and the terminals to be rotatable. When the pressing member rotates from an open position for inserting the flat conductive member into the receptacle portion to a close position, the terminals contact with the flat conductive member with an increased force.

According to an embodiment of the present invention, in the electrical connector, the metal member is formed of a metal plate. The metal member includes the engaging portion, and further includes an attaching portion attached to the housing. Further, the metal member is attached to the housing such that the attaching portion is situated in parallel to a plate surface of the terminals. The engaging portion engages the engagement portion of the flat conductive member, so that the flat conductive member does not come off backward.

In the present invention, the attaching portion and the engaging portion of the metal member are formed in a substantially flat plate shape. The terminals are arranged in a flat plane arrangement. Accordingly, it is possible to dispose the metal member in parallel to the terminals. As a result, a width of the electrical connector increases only by an increment corresponding to a plate thickness of the metal member, thereby reducing a size of the electrical connector in a width direction thereof. The metal member may be formed of a metal material with high strength, so that it is possible to obtain sufficient engagement strength with respect to the flat conductive member according to the plate thickness. Further, the metal member is formed in a substantially flat plate shape, thereby making it easy to produce.

According to an embodiment of the present invention, the housing is provided with a column portion disposed adjacent to the engaging portion of the metal member outside one of the terminals situated at an outermost position in the arrangement direction. The column portion includes an engaging surface situated at a position same as a plate surface of the engaging portion in a front-to-rear direction, so that the engaging surface can engage the engagement portion of the flat conductive member.

Accordingly, with the column portion disposed on the housing, it is possible to cooperatively engage the engagement portion of the flat conductive member with the column portion and the engaging portion of the metal member.

According to an embodiment of the present invention, in the column portion disposed on the housing, the engaging surface may be situated at a position slightly ahead of the plate surface of the engaging portion. Accordingly, the engaging surface of the column portion engages the engagement portion of the flat conductive member first. When the column portion deforms, the engaging portion of the metal member can engage the engagement portion of the flat conductive member, thereby providing a fail-safe design of the engagement structure.

According to an embodiment of the present invention, the engaging portion of the metal member may be formed of a rear edge of a groove portion formed in the metal member for receiving the engagement portion of the flat conductive member.

When the metal member is provided with the groove portion, it is preferred that the pressing member is provided with a guide member. The guide member is situated at a position covering at least a part of the engagement portion of the flat conductive member in the groove portion of the metal member when the pressing member rotates to the close position. Accordingly, when the pressing member is situated at the close position, the engagement portion of the flat conductive member does not move upward from the groove portion. As a result, it is possible to securely maintain the engagement portion in an engagement position relative to the engaging portion.

According to an embodiment of the present invention, it is preferred that the metal member is provided with a fixing portion capable of being connected to a circuit board with solder. When the fixing portion is connected to the circuit board with solder, the metal member is firmly fixed and the housing is reinforced with the metal member.

According to an embodiment of the present invention, the metal member may be situated at a plurality of positions. In this case, at least one of the metal members is situated at a position shifted from those of the other metal members in the front-to-rear direction. When a plurality of the metal members is situated at positions shifted with each other, it is possible to prevent the flat conductive member from inserting into the housing in an upside-down posture. A plurality of the metal members may have a same configuration, and is arranged at positions shifted with each other.

According to an embodiment of the present invention, when the flat conductive member is attached to the electrical connector, it is possible to obtain the electrical connector with the flat conductive member.

As described above, in the embodiments of the present invention, while maintaining a flat plate surface of a metal plate, the metal plate is processed to form the engaging portion of the metal member. The metal member is disposed on the housing such that the metal member is situated in parallel to the terminals. It is arranged that the engaging portion engages the engagement portion of the flat conductive member. Accordingly, it is possible to easily produce the electrical connector without bending a metal plate. Further, it is possible to limit a size of the electrical connector in the width direction thereof according to the plate thickness of the metal member, thereby reducing a size of the electrical connector in the width direction, or making it possible to increase the number of the terminals.

BRIEF DESCRIPTION OF THE DRAWINGS

FIGS. 3(A) and 3(B) are sectional views showing the electrical connector at a position of a metal member according to the first embodiment of the present invention, wherein FIG. 3(A) is a view when the pressing member is situated at an open position, and FIG. 3(B) is a view when the pressing member is situated at the close position;

DESCRIPTION OF THE PREFERRED EMBODIMENTS

Hereunder, embodiments of the present invention will be explained with reference to the accompanying drawings.

Figure 1:
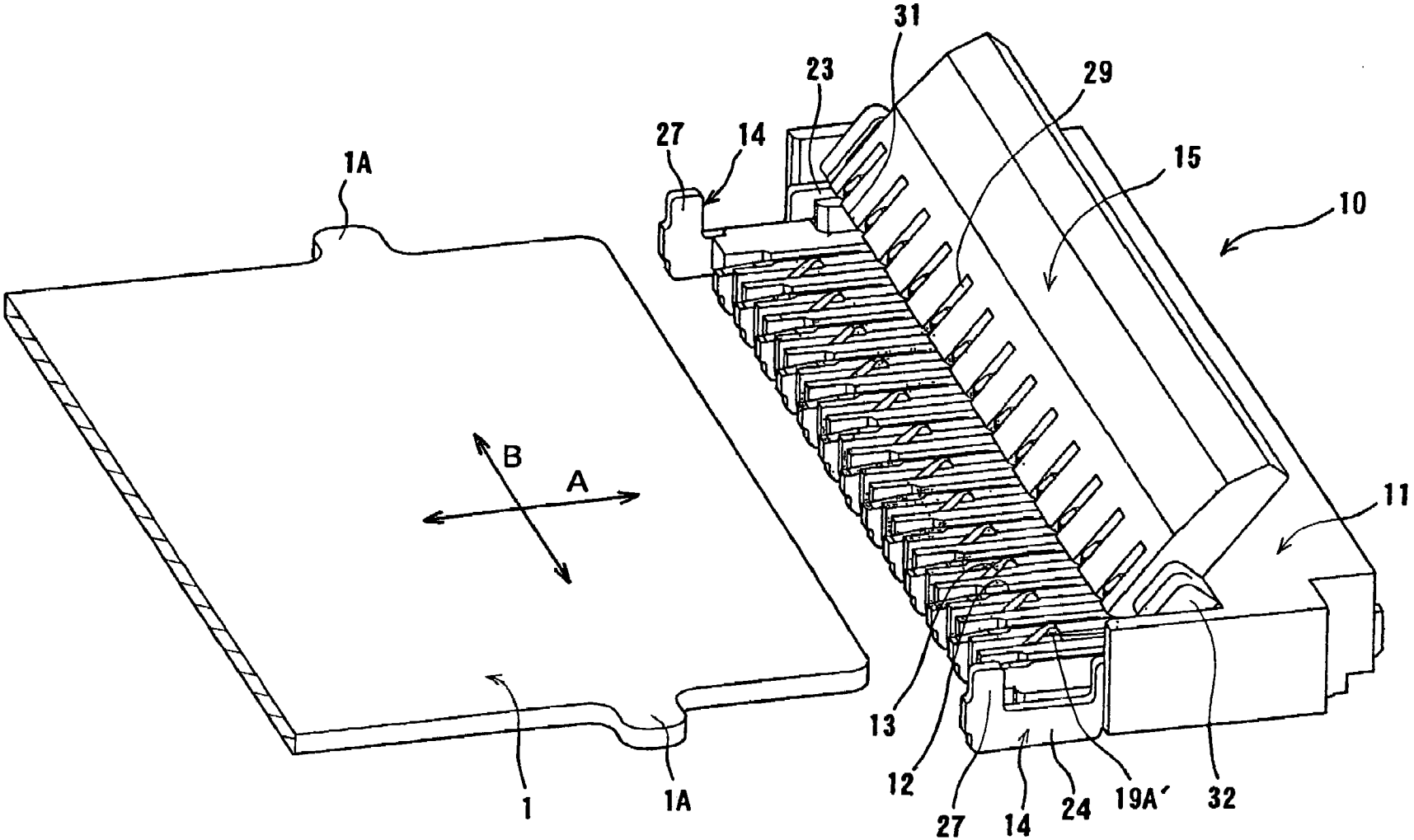
FIG. 1 is a perspective view showing an electrical connector and a flat conductive member to be connected to the electrical connector according to a first embodiment of the present invention.

FIG. 1 is a perspective view showing an electrical connector 10 and a flat conductive member 1 to be connected to the electrical connector 10 according to a first embodiment of the present invention. In the flat conductive member 1, a plurality of conductive members (not shown) is arranged next to each other along an arrow direction A perpendicular to an arrow direction B. Each of the conductive members is exposed at an end portion (right side in FIG. 1) of the flat conductive member 1. A reinforcement sheet is attached to an upper surface of the flat conductive member 1. Further, the flat conductive member 1 is provided with engagement portions 1A formed in an ear shape and disposed at both side edges on a distal end side of the reinforcement sheet.

In the embodiment, the electrical connector 10 to be connected to the flat conductive member 1 includes a housing 11 formed of an insulative material and arranged above a circuit board (not shown); a plurality of terminals 12 and 13 arranged on the housing 11 in double rows in parallel; metal members 14 attached to the housing 11 and disposed adjacent to ones of the terminals 12 and the terminals 13 at both side edges thereof in an arrangement direction that the terminals 12 and the terminals 13 are arranged; and a pressing member 15 supported on the terminals 12, the terminals 13, and the metal members 14 to be freely rotatable.

Figure 2:
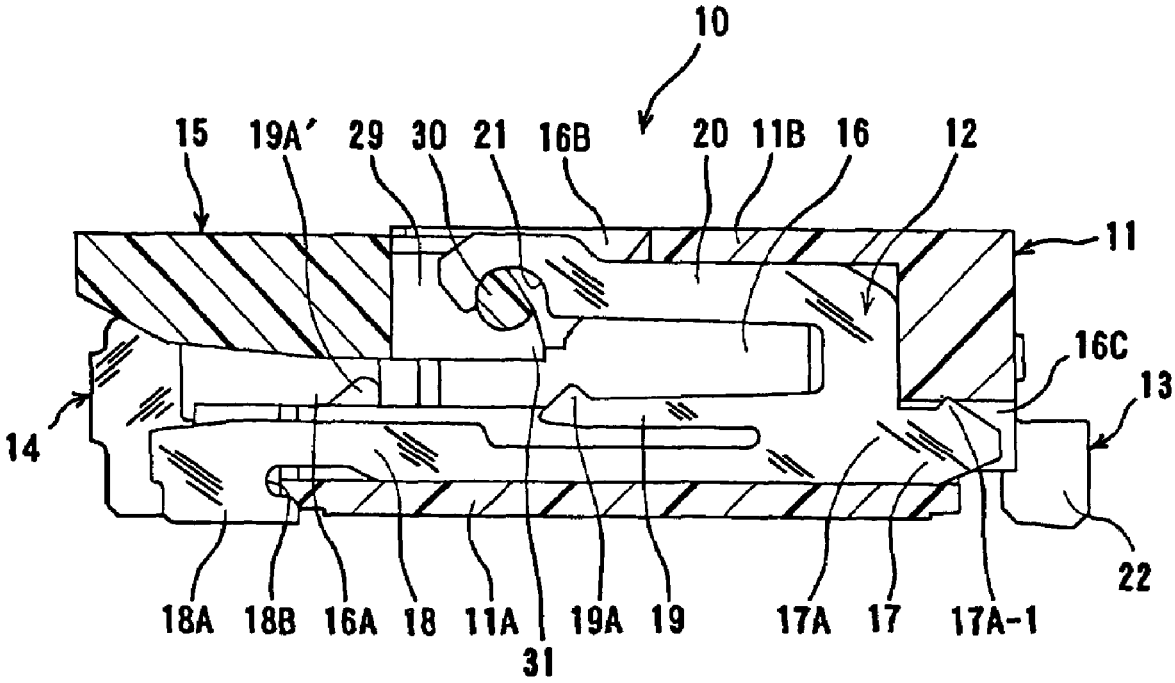
FIG. 2 is a sectional view showing the electrical connector at a position of a terminal when a pressing member is situated at a close position according to the first embodiment of the present invention.

FIG. 2 is a sectional view showing the electrical connector 10 at a position of one of the terminals 12. As shown in FIG. 2, the housing 11 is provided with a groove portion or terminal receptacle groove 16. In the embodiment, the terminal receptacle groove 16 is formed in a slit shape, and has a width corresponding to a plate thickness of the terminals 12 and the terminals 13 formed of metal plates. Further, the terminal receptacle groove 16 extends in a direction in parallel to a sheet surface of FIG. 2, and is arranged at a plurality of positions with a constant pitch along a direction perpendicular to the sheet surface of FIG. 2.

As shown in FIG. 2, the terminal receptacle groove 16 includes a left opening portion 16A opening to a left hand at a left side; an upper opening 16B opening upward at a left half of an upper wall; and a right opening 16C opening to a right hand at a lower side of a right side wall. The upper opening 16B of the terminal receptacle groove 16 communicates with that of the terminal receptacle groove 16 disposed next thereto in the direction perpendicular to the sheet surface of FIG. 2.

In the embodiment, each of the terminals 12 to be retained in the terminal receptacle groove 16 is formed of a metal plate having a flat plate shape. As shown in FIG. 2, each of the terminals 12 includes an attaching arm 17 fitted into the right opening 16C; a connecting arm 18 extending in a direction to a left hand opposite to the attaching arm 17; a contacting arm 19 situated above the connecting arm 18 and extending in parallel to the connecting arm 18; and a supporting arm 20 extending from a base portion 17A of the attaching arm 17 and then curving to a left hand.

In the embodiment, each of the terminals 12 is inserted into each of the terminal receptacle grooves 16 from the left side before the metal members 14 is attached. Accordingly, the attaching arm 17 enters the right opening 16C, so that the terminal 12 does not come off the terminal receptacle groove 16.

Further, the connecting arm 18 includes a connecting portion 18A protruding downward at a left side thereof and a fixing groove 18B formed in a right edge of the connecting portion 18A. When the terminal 12 is inserted into the terminal receptacle groove 16, the fixing groove 18B is fitted into a left side of a bottom surface of the housing 11, so that the terminal 12 does not come off the terminal receptacle groove 16. The connecting portion 18A has a lower edge slightly protruding downward with respect to a bottom surface of a lower wall 11A of the housing 11. Accordingly, it is possible to securely connect to a corresponding circuit portion of the circuit board with solder.

In the embodiment, the contacting arm 19 has a short and small shape. Further, the contacting arm 19 has elasticity, and includes a contacting portion 19A in a protrusion shape at a distal end thereof.

In the embodiment, the supporting arm 20 has an upper edge abutting against an inner surface of an upper wall 11B of the housing 11 for support. A distal end of the supporting arm 20 protrudes forward beyond the upper wall 11B and reaches a position of the upper opening 16B of the terminal receptacle groove 16. The distal end of the supporting arm 20 is formed in an inverted U character shape to form a groove portion as a rotation supporting portion 21 for supporting the metal member 14. Further, the distal end of the supporting arm 20 is situated in the upper opening 16B of the terminal receptacle groove 16, and has elasticity.

In the embodiment, the terminals 13 are arranged alternately with respect to the terminals 12. As compared with the terminals 12, each of the terminals 13 includes a supporting arm (not shown) having a shape similar to that of the supporting arm 20. In this case, a portion corresponding to the rotation supporting portion 21 may be omitted. Further, each of the terminals 13 includes a contacting arm extending further than the contacting arm 19 of the terminal 12. The contact arm of the terminal 13 includes a contact portion 19A' arranged alternately with respect to the contacting arm 19 of the terminal 12 when viewed from above.

In the embodiment, each of the terminals 13 includes a connecting arm extending to a right hand and having a connecting portion 22 at a distal end thereof. Each of the terminals 13 is inserted into a corresponding terminal receptacle groove (not shown) formed in the housing 11 from the right side.

Figure 3:
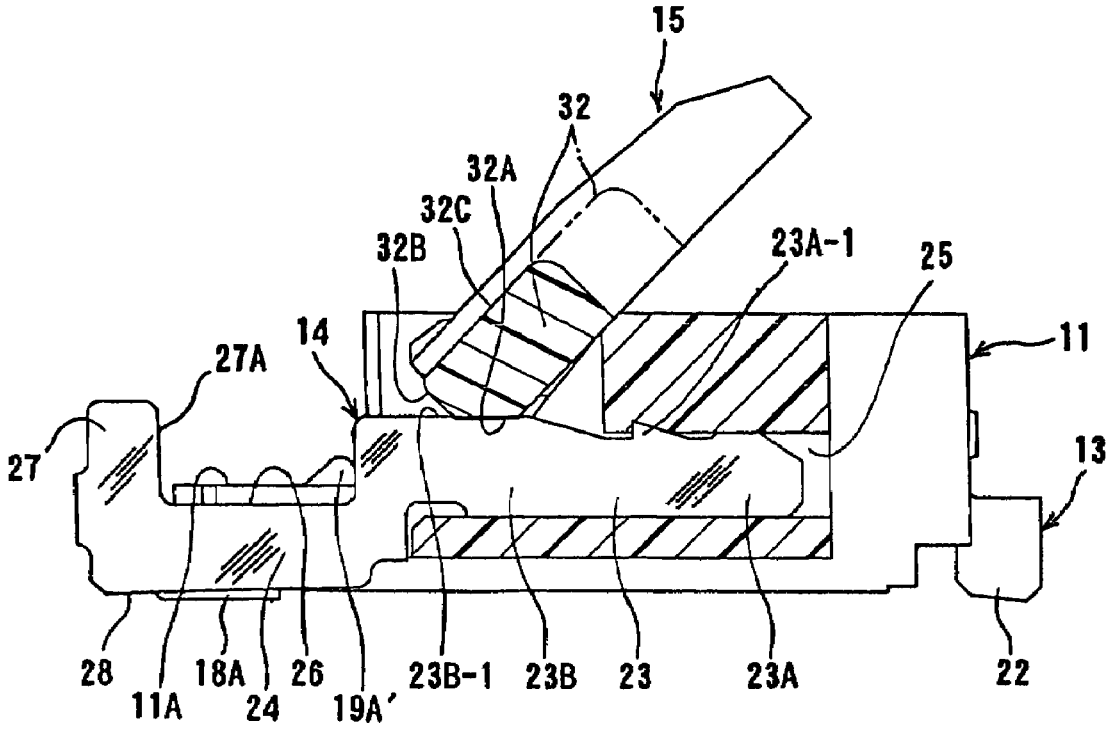
Figure 3:
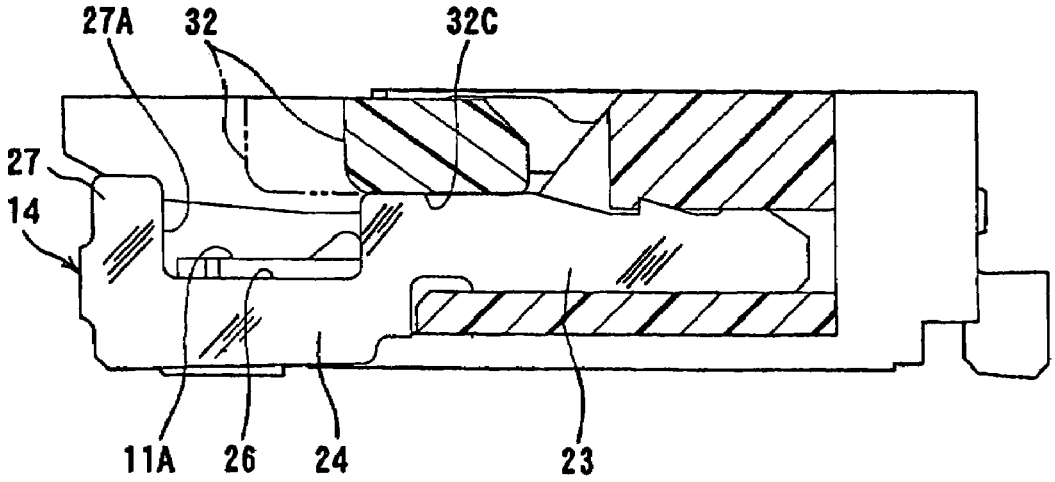

In the embodiment, similar to the terminals 12 and the terminals 13, each of the metal members 14 is formed of a metal plate having a flat plate shape. As shown in FIG. 3(A), each of the metal members 14 includes an attaching portion 23 to be retained in the housing 11 and a protruding portion 24 protruding outside the housing 11.

The attaching portion 23 extends linearly in horizontal direction, and has a distal end portion 23A fitted in an attaching hole 25 with a slit shape formed in the housing 11. An engaging protrusion 23A-1 is formed on an upper edge of the distal end portion 23A, and bites into an inner wall of the attaching hole 25, so that the metal member 14 does not come out. The attaching portion 23 further includes an outer portion 23B situated outside the attaching hole 25 in the upper opening 16B of the housing 11. A rotation guide portion 23B-1 having a linear shape is formed on an upper edge (plate thickness surface) of the outer portion 23B for guiding the pressing member 15.

In the embodiment, the protruding portion 24 of the metal member 14 is curved in a U character shape to form a groove portion 26, and is provided with an engaging portion 27 protruding upward at a read edge thereof. The groove portion 26 has a bottom surface situated below the lower wall or supporting surface 11A of the housing 11, so that the electrical connector 10 securely supports the flat conductive member 1. The groove portion 26 extends backward toward outside the housing 11 beyond a rear edge of a sidewall of the housing 11. When the metal members 14 is situated at the close position (described later), a space between the groove portions 26 at both sides opens, thereby making it easy to insert the flat conductive member 1 into the electrical connector 10.

When the metal members 14 press the flat conductive member 1 and the contact portions 19A and 19A' of the terminals 12 and the terminals 13 deform downward, the flat conductive member 1 is supported on the supporting surface 11A. The groove portions 16 have a groove width and a groove depth large enough for accommodating the engagement portions 1A of the flat conductive member 1. That is, in the groove portion 16, the engaging portion 27 at a front edge of the groove portion 16 has a plate thickness surface 27A at a front edge thereof having a height large enough for engaging the engagement portion 1A of the flat conductive member 1. Note that the groove portions 16 may have an arbitrary groove depth as far as being capable of engaging the engagement portions 1A of the flat conductive member 1.

In the embodiment, the protruding portion 24 of the metal member 14 has a lower edge 28 having a slightly inclined surface. As shown in FIG. 3(A), the lower edge 28 has a lowest point at a left end thereof for contacting with the circuit board. The lower edge 28 functions as a fixing portion to be connected to the circuit board with solder.

When the circuit board is connected to the lower edge 28 with solder, solder contacts with the left end first, and gradually flows toward a right side, so that the lower edge 28 is fixed with solder over an overall length thereof. When the flat conductive member 1 is pulled backward, a force applied to the engaging portion 27 generates moment around the left side of the lower edge 28. Accordingly, it is possible to securely receive the force along with the circuit board.

In the embodiment, the pressing member 15 has a flat plate shape as shown in FIG. 1 and a lever shape as shown in FIG. 3(A). The pressing member 15 has a width sufficiently covering an arrangement range of the terminals 12 and the terminals 13. As shown in FIG. 1, when the pressing member 15 is situated at the open position, there is the space for inserting the flat conductive member 1 into the electrical connector 10 through the left opening portion 16A (FIG. 2), so that the front edge of the flat conductive member 1 is situated above the contact portions 19A and 19A' of the terminals 12 and the terminals 13.

As shown in FIG. 2, when the pressing member 15 is situated at the close position, the pressing member 15 becomes a horizontal posture. Further, the pressing member 15 is supported on the terminals 12 and the terminals 13 at an upper side thereof and on the metal members 14 at a lower side thereof to be rotatable between the open position and the close position.

In the embodiment, the pressing member 15 has groove portions 29 having a slit shape at positions corresponding to the terminals 12 and the terminals 13 along the arrangement direction of the terminals 12 and the terminals 13, so that the distal end portions of the supporting arms 20 of the terminals 12 enter the groove portions 29.

As shown in FIG. 2, a shaft portion 30 having an island shape is disposed inside the groove portion 29. The shaft portion 30 is accommodated in the rotation supporting portion 21 of the terminal 12 to be rotatable. Note that the terminals 13 do not have a rotation supporting portion. Further, the pressing member 15 has pressing portions 31 as protruding portions adjacent to the shaft portions 30 for pressing the flat conductive member 1 upon rotating.

In the embodiment, the pressing member 15 further includes sub-shaft portions 32 at both sides thereof in the arrangement direction of the terminals 12 and the terminals 13. As shown in FIG. 3(A), the sub-shaft portion 32 has a substantially rectangular section. That is, the sub-shaft portion 32 has a first side 32A as a lower side thereof as an obliquely cut portion; a second side 32B adjacent to the first side 32A; and a third side 32C extending from the second side 32B. The first side 32A contacts with and is supported on the rotation guide portion 23B-1 formed on the metal member 14, so that the pressing member 15 is stably situated at the open position.

When the pressing member 15 rotates toward the close position, in the sub-shaft portions 32, the first sides 32A contact with the rotation guide portions 23B-1 first, and then the second sides 32B contact with the rotation guide portions 23B-1. Afterward, the third sides 32C contact with the rotation guide portions 23B-1. During the rotation, the pressing member 15 is supported on the rotation supporting portions 21 of the terminals 12 at the shaft portions 30 from below. Accordingly, when a rotational center of the pressing member 15 moves during the rotation, the shaft portions 30 do not come out of the rotation supporting portions 21.

As shown in FIG. 3(B), when the pressing member 15 is situated at the close position, the third sides 32C of the sub-shaft portions 32 contact with the rotation supporting portions 21 of the metal members 14, thereby stabilizing the posture.

An operation of the flat conductive member 1 will be explained next. First, the electrical connector 10 is placed on the circuit board (not shown) at a specific position. Then, the contacting portions 18A and 22 of the terminals 12 and the terminals 13 are connected to the corresponding circuit portions with solder. Further, the metal members 14 are fixed to corresponding portions at the lower edges 28 thereof.

Figure 4:
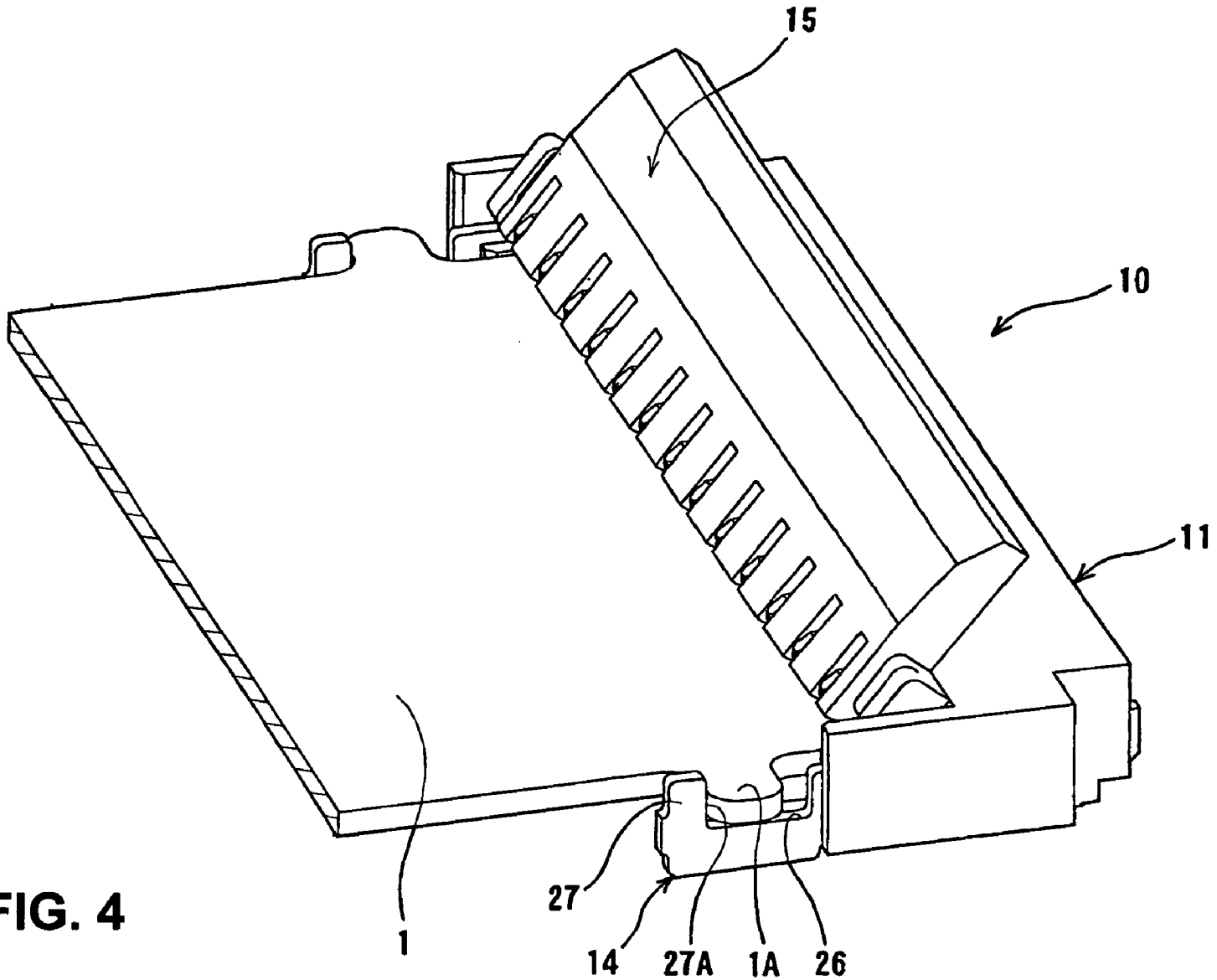
FIG. 4 is a perspective view showing the electrical connector with the flat conductive member connected thereto when the pressing member is situated at the open position according to the first embodiment of the present invention.

When the pressing member 15 moves to the open position shown in FIG. 1 and FIG. 3(A), the left opening portions 16A of the electrical connector 10 widely opens. As shown in FIG. 4, the flat conductive member 1 is placed in the electrical connector 10, so that the engagement portions 1A are situated in the groove portions 26 of the metal members 14. When the engagement portions 1A are accommodated in the groove portions 26, the cables exposed on the lower surface of the flat conductive member 1 at the front end thereof are situated on the contact portions 19A and 19A' of the terminals 12 and the terminals 13.

Figure 5:
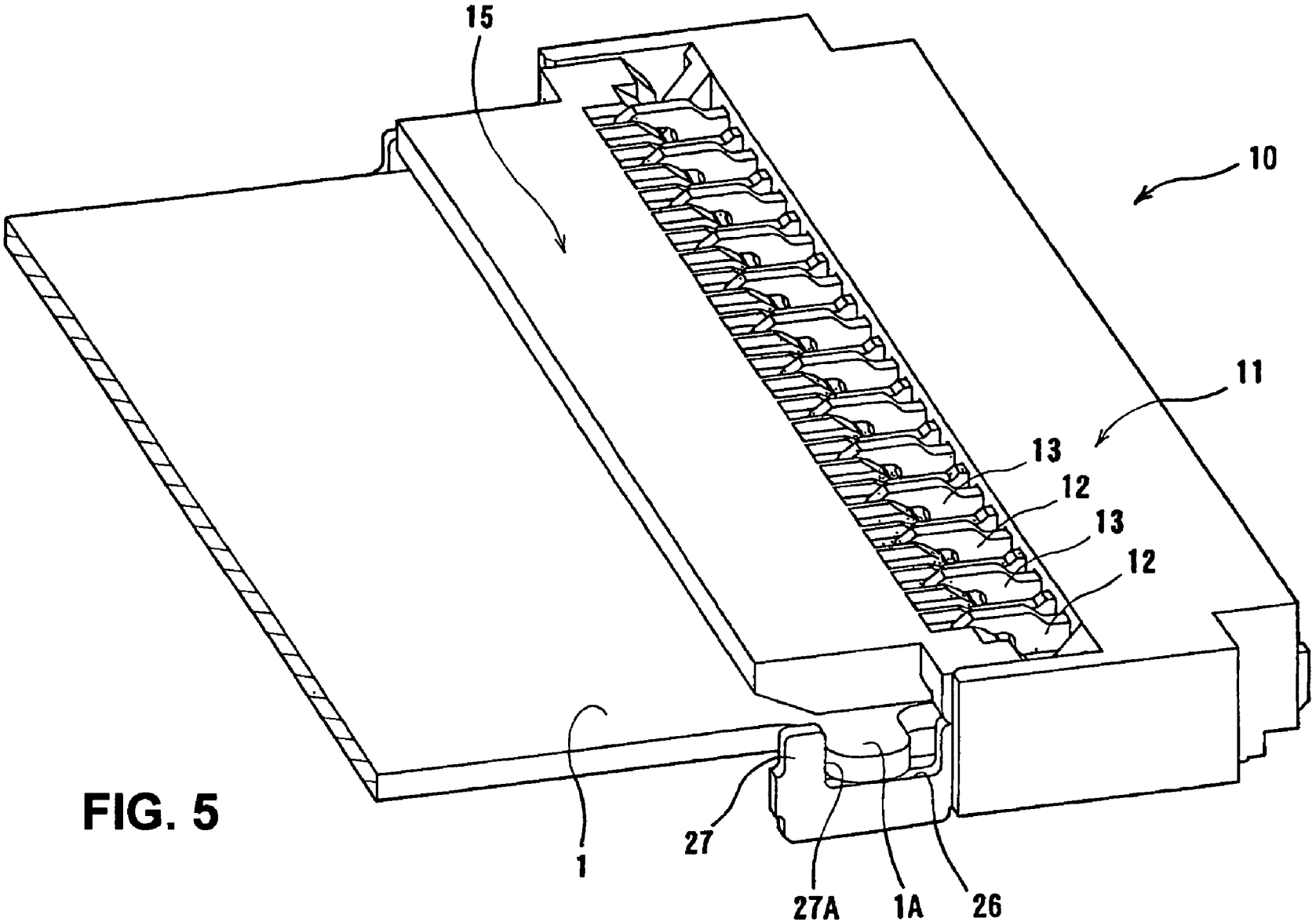
FIG. 5 is a perspective view showing the electrical connector with the flat conductive member connected thereto when the pressing member is situated at the close position according to the first embodiment of the present invention.

When the pressing member 15 rotates to the close position shown in FIG. 3(B) and FIG. 5, the pressing portions 31 of the pressing member 15 press the flat conductive member 1 against the terminals 12 and the terminals 13, so that the contact portions 19A and 19A' are electrically connected to the flat conductive member 1 with an increased pressing force. At this moment, the pressing member 15 is situated close to the upper portion of the flat conductive member 1. Accordingly, it is possible to prevent the flat conductive member 1 from lifting from the supporting surface 11A of the housing 11.

As shown in FIGS. 3(A) and 3(B), when the sub-shaft portions 32 of the pressing member 15 are formed to extend further toward the front edge of the pressing member 15 (indicated with phantom lines), the sub-shaft portions 32 cover the engagement portions 1A of the flat conductive member 1 at the close position. Accordingly, the engagement portions 1A do not lift from the groove portions 26 of the metal members 14.

In the embodiment, in the flat conductive member 1, rear edges of the engagement portions 1A face the plate thickness surfaces 27A of the engaging portions 27 of the metal members 14 or the rear edges of the groove portion 26. In a state that the pressing member 15 is situated at the open position and just after the flat conductive member 1 is inserted, even when the flat conductive member 1 is pulled backward, the engagement portions 1A abut against the plate thickness surfaces 27A of the engaging portions 27, thereby preventing the flat conductive member 1 from coming off. Further, even in a state that the pressing member 15 is situated at the close position and the flat conductive member 1 is connected to the terminals 12 and the terminals 13, the engagement portions 1A abut against the plate thickness surfaces 27A of the engaging portions 27, thereby preventing the flat conductive member 1 from coming off.

Figure 6:
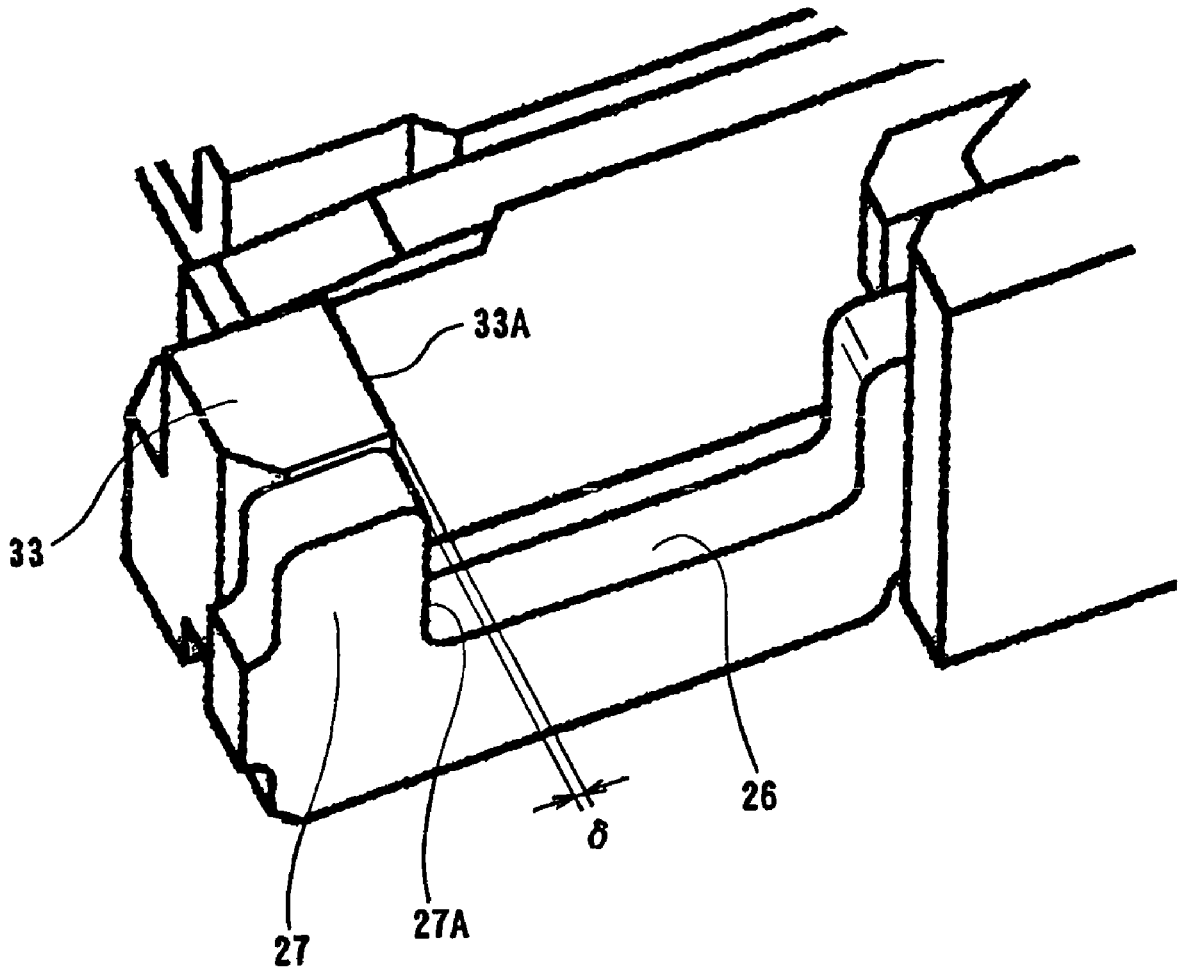
FIG. 6 is a perspective view showing an electrical connector according to a second embodiment of the present invention.

In the present invention, in addition to the embodiment shown in FIG. 1 to 5, various modifications are possible. FIG. 6 is a perspective view showing the electrical connector 10 according to a second embodiment of the present invention.

As shown in FIG. 6, a column portion 33 is disposed on the housing 11 inside and adjacent to the engaging portion 27 of the metal member 14 along the arrangement direction of the terminals 12 and the terminals 13. In the embodiment, the column portion 33 has a rectangular column shape, and includes an engaging surface 33A situated at a position substantially same as that of the plate thickness surface 27A of the engaging portion 27 in the front-to-rear direction, or at a position shifted forward by a distance δ with respect to the plate thickness surface 27A.

With the configuration described above, the engagement portion 1A of the flat conductive member 1 engages the plate thickness surface 27A of the engaging portion 27 and the engaging surface 33A of the column portion 33. Accordingly, it is possible to reduce load applied to the engaging portion 27 and improve positional accuracy of the engagement portion 1A.

In the embodiment, the housing 11 is formed through molding with high accuracy. Further, the column portion 33 provides the positional accuracy, and the metal members 14 provide strength.

When the engaging surface 33A of the column portion 33 is situated at a position substantially same as that of the plate thickness surface 27A of the engaging portion 27 in the front-to-rear direction, the engaging surface 33A and the plate thickness surface 27A receive a force from the engagement portion 1A from the beginning.

When the engaging surface 33A of the column portion 33 is situated at a position shifted forward by the distance 5 with respect to the plate thickness surface 27A of the engaging portion 27, the engaging surface 33A of the column portion 33 receives the force from the engagement portion 1A first. After the column portion 33 or the engagement portion 1A elastically deforms to some extent, the engaging surface 33A and the plate thickness surface 27A receive a force from the engagement portion 1A.

In the present invention, in the metal members 14, it is sufficient that the engaging portion 27 and the attaching portion 23 have a flat plate shape. That is, viewed from the arrangement direction of the terminals 12 and the terminals 13, the engaging portion 27 and the attaching portion 23 look overlapped with the terminals 12 and the terminals 13. With this configuration, when the terminals 12 and the terminals 13 are arranged next to each other such that the plate surfaces match with each other, the electrical connector 10 has a width increased only by the plate thickness of the metal members 14. Even when the metal members 14 are bent in the plate thickness direction, the electrical connector 10 has a same width.

Figure 7:
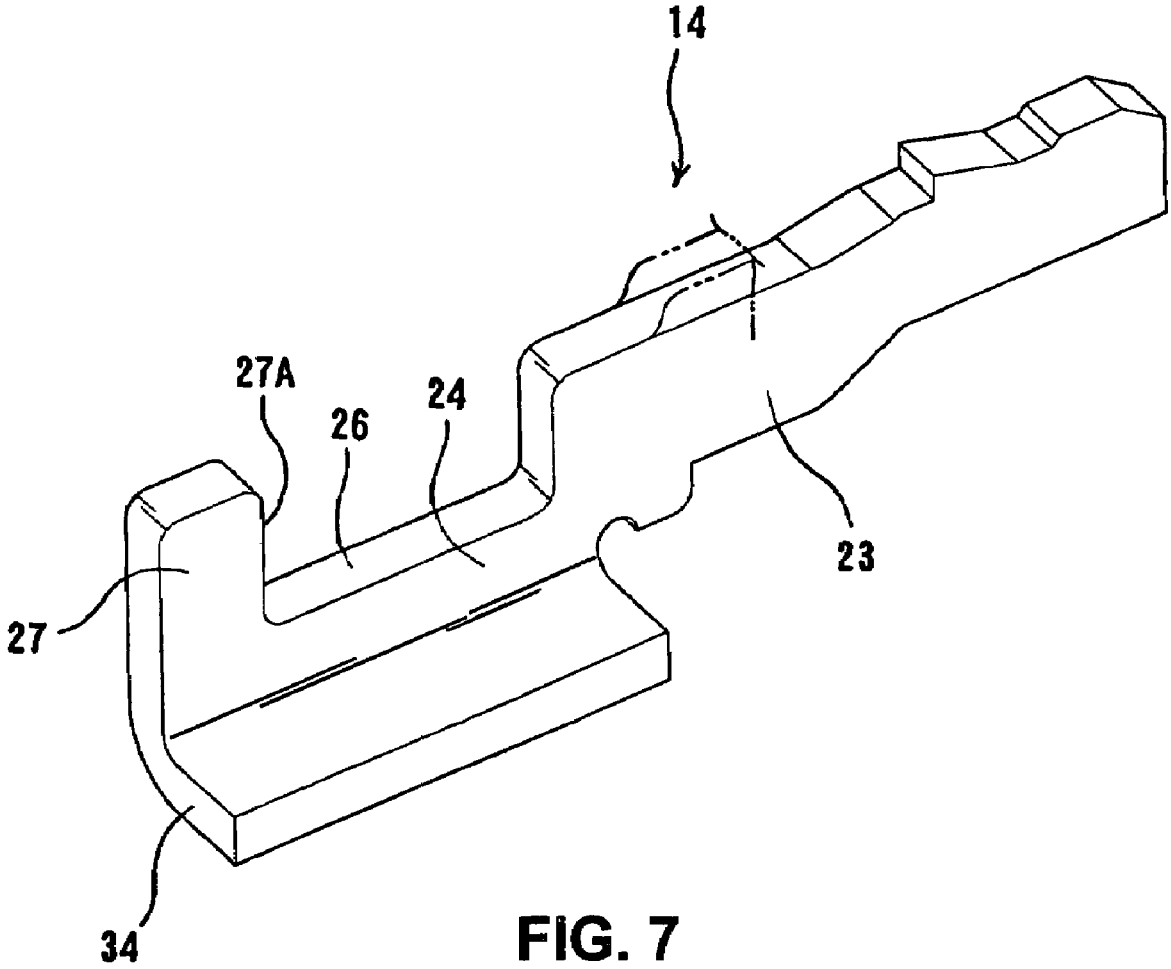
FIG. 7 is a perspective view showing a metal member according to a third embodiment of the present invention.

FIG. 7 is a perspective view showing the metal member 14 according to a third embodiment of the present invention. As shown in FIG. 7, a fixing portion 34 extends from the protruding portion 24 of the metal member 14 to form an L character shape. In the third embodiment, note that the attaching portion 23 and the engaging portion 27, i.e., a main portion of the metal member 14, are still formed in a flat plate shape. With the fixing portion 34, it is possible to increase strength of the metal member 14 without increasing the width of the electrical connector 10. Further, it is possible to increase an area of the metal member 14 to be connected to the circuit board with solder, thereby increasing holding strength thereof.

As described above, in the metal members 14, it is sufficient that the engaging portion 27 and the attaching portion 23 have a flat plate shape. Accordingly, as indicated with phantom lines in FIG. 7, the metal members 14 may have a curved portion curved in the thickness direction of the metal member 14 by a thickness of the metal member 14 or a half thereof to form a crank shape.

Figure 8:
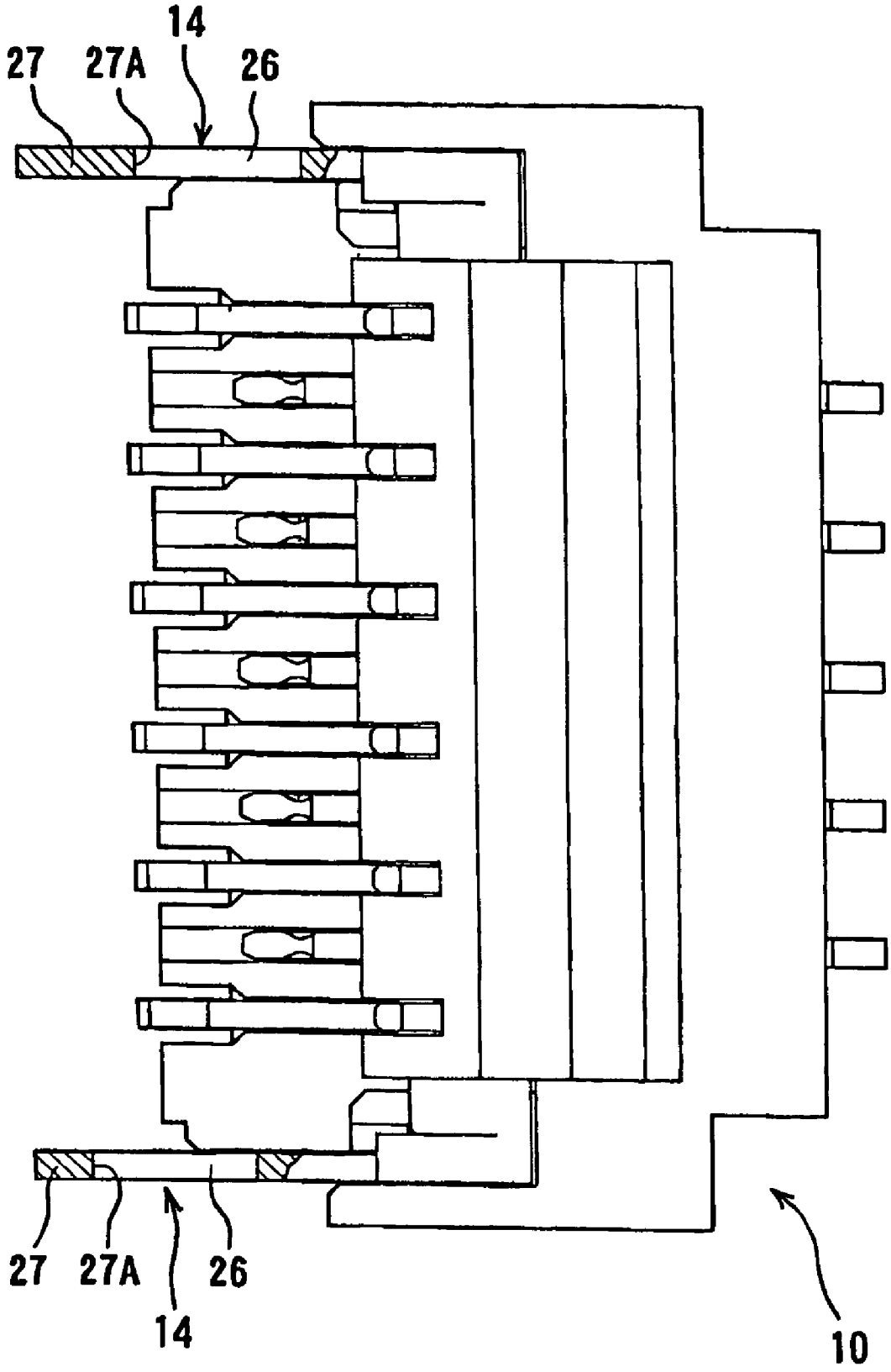
FIG. 8 is a plan view showing an electrical connector according to a fourth embodiment of the present invention.

FIG. 8 is a plan view showing the electrical connector 10 according to a fourth embodiment of the present invention. In the electrical connector 10, the groove portion 26 of the metal members 14 or the engaging portion 27 are situated at positions shifted with each other in the front-to-rear direction. With this configuration, it is possible to insert only the flat conductive member 1 having the engagement portions 1A at positions corresponding the engaging portion 27. Accordingly, it is possible to prevent the flat conductive member 1 from inserting in an upside-down posture.

The disclosure of Japanese Patent Application No. 2006-124613, filed on Apr. 28, 2006, is incorporated in the application by reference.

While the invention has been explained with reference to the specific embodiments of the invention, the explanation is illustrative and the invention is limited only by the appended claims.

What is claimed is:

1. An electrical connector to be connected to a flat conductive member having an engagement portion protruding from a side edge of the flat conductive member, comprising:

a housing;

a terminal disposed in the housing, said terminal having a plate shape extending in a first direction, said terminal including a plurality of terminal sections arranged in the housing along a second direction perpendicular to the first direction;

a pressing member supported on at least one of the housing and the terminal to be rotatable between an open position where the flat conductive member can be inserted into the housing and a close position where the terminal contacts with the flat conductive member; and a metal member attached to the housing outside the housing in the second direction and having a substantially flat plate shape, said metal member including an engaging portion for engaging the engagement portion and an attaching portion attached to the housing, said engaging portion being formed at a distal end portion of the metal member and situated outside the housing, said attaching portion extending in parallel to the terminal along the first direction, wherein said pressing member includes a sub-shaft portion having a first surface contacting with an upper edge of the metal member at the open position and a second surface contacting with the upper edge of the metal member at the close position.

2. The electrical connector according to claim 1, wherein said terminal includes a contact portion for contacting the flat conductive member.

3. The electrical connector according to claim 1, wherein said metal member further includes a groove portion, said engaging portion being formed on an edge of the groove portion.

4. The electrical connector according to claim 1, wherein said pressing member includes a guide portion, said guide portion covering the engagement portion when the pressing member is situated at the close position.

5. The electrical connector according to claim 1, further comprising a fixing portion to be connected to a circuit board with solder, said fixing portion extending from the metal member in the thickness direction.

6. The electrical connector according to claim 1, wherein said metal member further includes a first metal member and a second metal member shifted with respect to the first metal member along the first direction.

7. The electrical connector according to claim 1, wherein said terminal includes a rotation supporting portion, said pressing member including a shaft portion accommodated in the rotation supporting portion to be rotatable.

8. The electrical connector according to claim 1, wherein said metal member is disposed adjacent to a sidewall of the housing so that the engagement portion protrudes sideward through the engaging portion when the flat conductive member is connected to the electrical connector.

9. The electrical connector according to claim 1, wherein said housing includes a column portion having an engaging surface for engaging the engagement portion.

10. The electrical connector according to claim 9, wherein said column portion is disposed adjacent to the metal member.

11. The electrical connector according to claim 9, wherein said engaging surface is situated at a position substantially same as that of the engaging portion along the first direction.

12. The electrical connector according to claim 9, wherein said engaging surface is situated at a position shifted with respect to that of the engaging portion along the first direction.

13. An electrical connector with a flat conductive member protruding from a side edge of the flat conductive member, comprising:

the flat conductive member having an engagement portion;

a housing;

a terminal disposed in the housing, said terminal having a plate shape extending in a first direction, said terminal including a plurality of terminal sections arranged in the housing along a second direction perpendicular to the first direction;

a pressing member supported on at least one of the housing and the terminal to be rotatable between an open position and a close position; and a metal member attached to the housing outside the housing in the second direction, said metal member including an engaging portion for engaging the engagement portion and an attaching portion attached to the housing, said attaching portion extending in parallel to the terminal along the first direction, said engaging portion being situated outside the housing, wherein said pressing member includes a sub-shaft portion having a first surface contacting with an upper edge of the metal member at the open position and a second surface contacting with the upper edge of the metal member at the close position.

14. The electrical connector according to claim 13, wherein said pressing member is arranged to rotate between the open position where the flat conductive member can be inserted into the housing and the close position where the terminal contacts with the flat conductive member.

15. The electrical connector according to claim 13, wherein said terminal includes a rotation supporting portion, said pressing member including a shaft portion accommodated in the rotation supporting portion to be rotatable.

16. An electrical connector to be connected to a flat conductive member having an engagement portion protruding from a side edge of the flat conductive member, comprising:

a housing;

a terminal disposed in the housing, said terminal having a plate shape extending in a first direction, said terminal including a plurality of terminal sections arranged in the housing along a second direction perpendicular to the first direction;

a pressing member supported on at least one of the housing and the terminal to be rotatable between an open position and a close position; and a metal member attached to the housing outside the housing in the second direction and having a curved portion curved in a thickness direction of the metal member, said metal member including an engaging portion for engaging the engagement portion and an attaching portion attached to the housing, said engaging portion being formed at a distal end portion of the metal member and situated outside the housing, said attaching portion extending in parallel to the terminal along the first direction, wherein said pressing member includes a sub-shaft portion having a first surface contacting with an upper edge of the metal member at the open position and a second surface contacting with the upper edge of the metal member at the close position.

17. The electrical connector according to claim 16, wherein said pressing member is arranged to rotate between the open position where the flat conductive member can be inserted into the housing and the a close position where the terminal contacts with the flat conductive member.

18. The electrical connector according to claim 16, wherein said terminal includes a rotation supporting portion, said pressing member including a shaft portion accommodated in the rotation supporting portion to be rotatable.

* * * * *